United States Patent [19]

Close

[11] Patent Number: 4,995,590

[45] Date of Patent: Feb. 26, 1991

[54] FENCE POST INSTALLATION

[76] Inventor: Gregg V. Close, 18915 SE. Petrovitsky Rd., Renton, Wash. 98058

[21] Appl. No.: 511,190

[22] Filed: May 15, 1990

[51] Int. Cl.[5] ..... E04H 17/16

[52] U.S. Cl. ..... 256/24; 256/23; 256/73

[58] Field of Search ..... 256/19, 24, 65, 73, 256/23

[56] References Cited

U.S. PATENT DOCUMENTS 1,136,999 4/1915 Bondy ..... 256/65 X 1,429,084 9/1922 Loeffler ..... 256/24

3,614,068 10/1971 Koehl ..... 256/19

4,143,859 3/1979 Tews ..... 256/19 X

FOREIGN PATENT DOCUMENTS 2496153 6/1982 France ..... 256/19

*Primary Examiner*—Andrew V. Kundrat

[57] ABSTRACT

A permanent fence post fabricated of cement incorporating reinforcement elements 10 interacting with and secured to straps 6 which extend through the post transverse to the length thereof and serve to support framing members 4.

3 Claims, 2 Drawing Sheets

FIG. 1
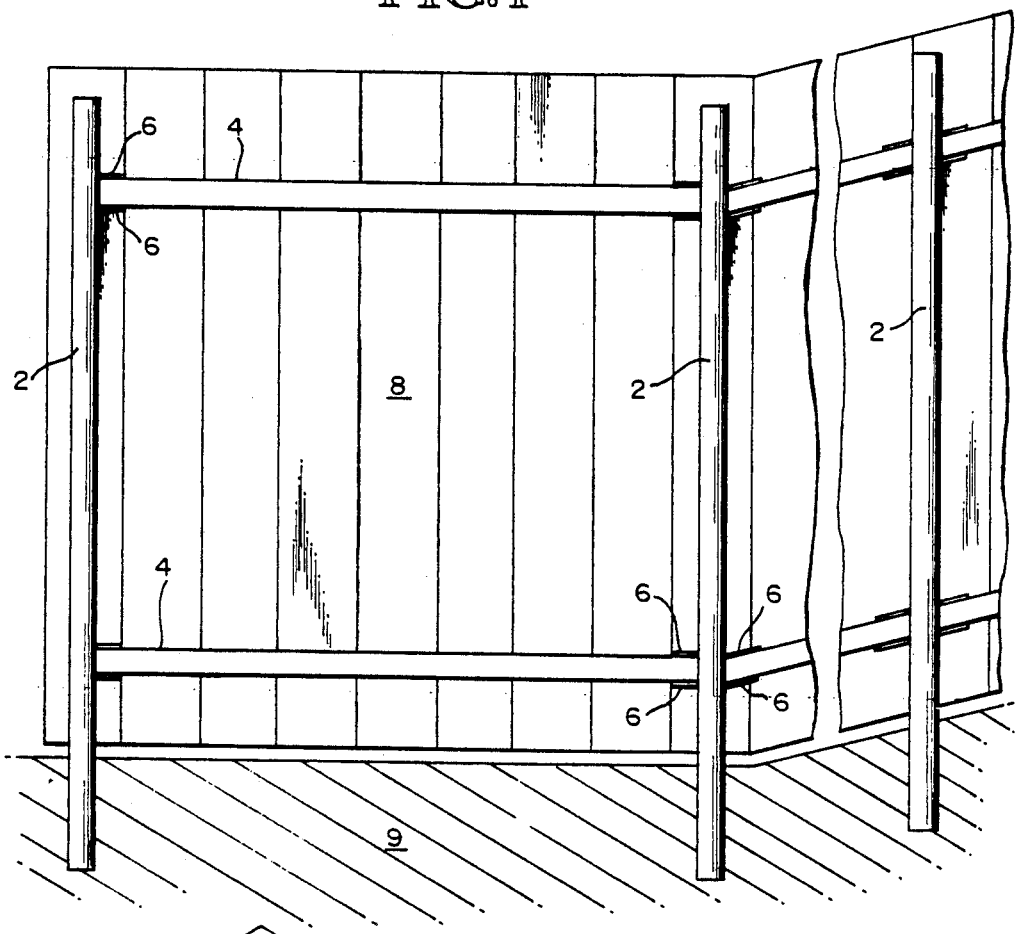
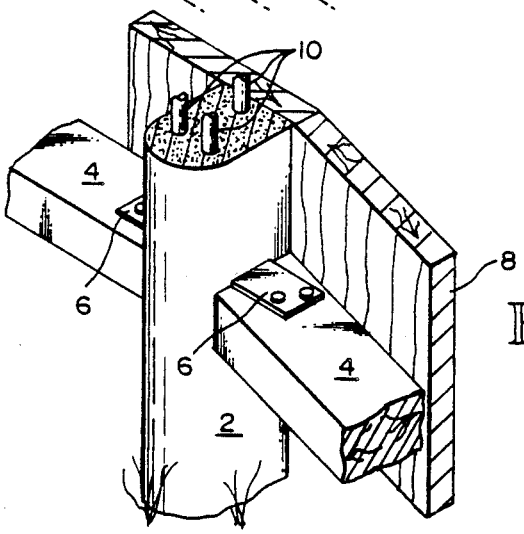
FIG. 2

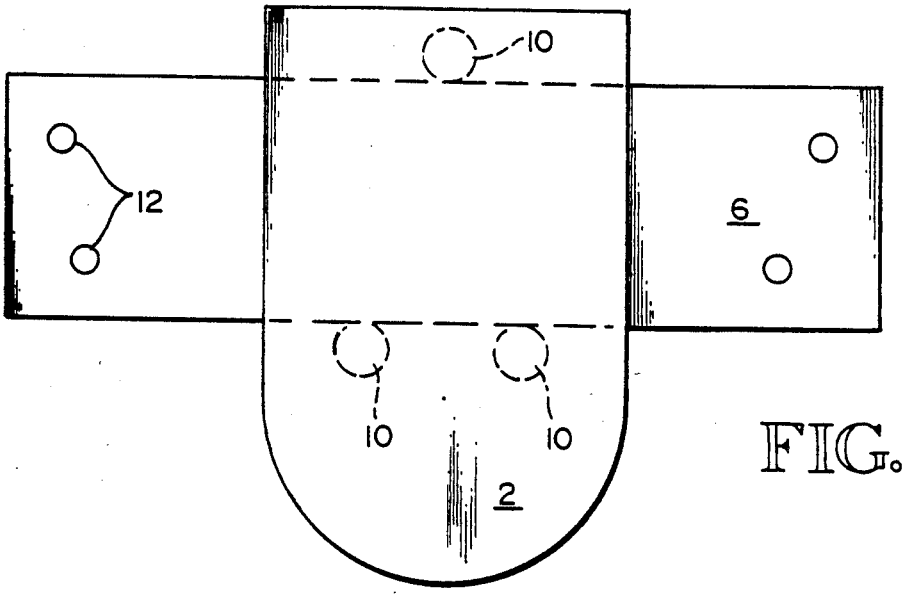
FIG. 3
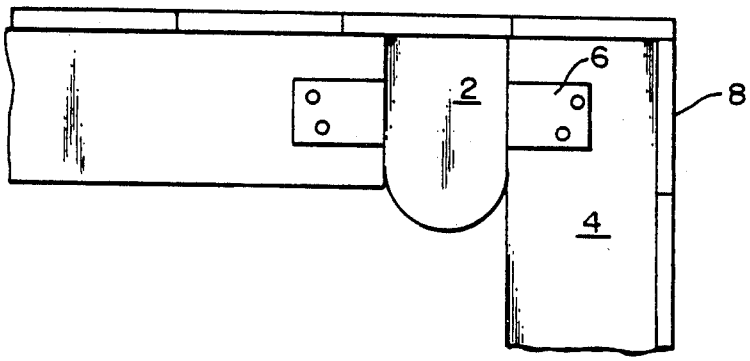
FIG. 4
FIG. 5
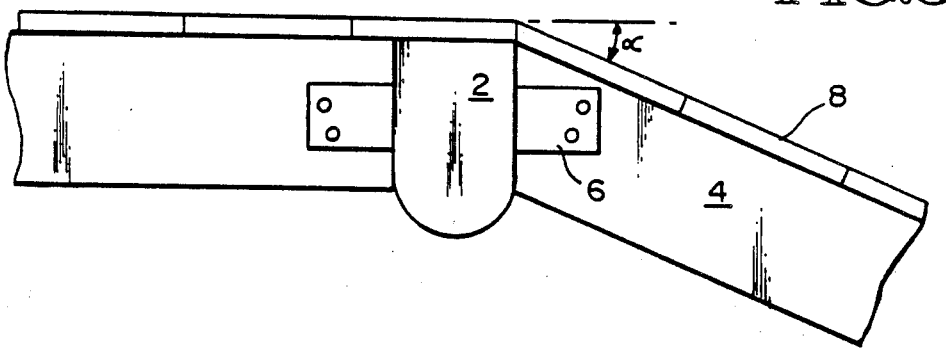

FENCE POST INSTALLATION

DESCRIPTION

1. Technical Field

This invention relates to fence posts and more particularly to a fence post preferably fabricated of concrete and including rebar reinforcing which is secured to and captures at least one pair of outwardly extending straps for securement to horizontal framing which will in turn support the fence boards wherein said straps extend through the post.

2. Background Art

Fences for privacy or security have long been in use and will continue to be used.

Traditionally, fences have been fabricated using wooden posts and the first portion of a fence to succumb to the deterioration process is the post where it extends into the ground.

Numerous attempts have been made to fabricate and market substitutes for the wooden fence posts, but either because of cost, appearance or other factors they have not substantially impacted the market.

Specific examples of fabricated posts include that disclosed in U.S. Pat. No. 821,535, granted to Perkins on May 23, 1906 which discloses a post made of plastic material having longitudinal reinforcing means which are also used to secure hooks for in turn securing fencing wire and the like.

U.S. Pat. No. 3,385,566, granted to Dwyer on May 28, 1968 discloses a cement fence post including outwardly extending clips for securing horizontal boards. The cement post also includes longitudinal reinforcing means.

U.S. Pat. No. 3,614,068, granted to Koehl on Oct. 119, 1971 discloses a portable livestock pen which includes reinforced cement posts and interlinking modular-connecting sections.

U.S. Pat. No. 44,142,711, granted to Brimhall on Mar. 6, 1979 discloses a cement post for use in combination with wooden interconnectors and includes interior reinforcing means interconnected with outwardly extending threaded shafts for securement of the wooden members.

U.S. Pat. No. 4,143,859, granted to Tews on Mar. 13, 1979 discloses a cement fence post including internal reinforcing means interconnected with an outwardly extending strap and projecting through the upper portion of the post for interaction with an inverted L-shaped fence securement member which also is secured to the straps.

DISCLOSURE OF THE INVENTION

With the above-noted prior art and problems in mind, it is an object of the present invention to provide a permanent fence post which is both inexpensive and attractive.

It is another object of the present invention to provide a permanent fence post which includes integral interactive members making it simple to use as a section of a modular fence unit.

It is still another object of the present invention to provide a pre-cast cement fence post which includes a novel internal structure which increases its durability and utility.

Still another object of the present invention is to provide a pre-cast fence post of a structure which enables it to be fabricated quickly and inexpensively.

BRIEF DESCRIPTION OF THE DRAWINGS

FIG. 1 is an elevational view of a fence built in accordance with the present invention.

FIG. 2 is an isometric view of a fence in accordance with the present invention depicting a slight bend in the fence.

FIG. 3 is a top view of the inventive fence post, illustrating the framing strap and the interrelated reinforcing elements.

FIG. 4 is a top view of a fence including a 90° corner and utilizing the present invention.

FIG. 5 is a top view of a fence spanning an acute angle using the present invention.

BEST MODE FOR CARRYING OUT THE INVENTION

As seen in FIG. 1, a typical fence section would include a plurality of parallel posts 2 which extend along the desired fence line at distances of 8 feet or other predetermined distances apart interconnected by framing means 4 which are secured to the posts 2 by means of spaced parallel straps 6 which, as will be explained hereinafter, extend through the post 2 outwardly on opposite parallel sides thereof. It is to be noted that at the right-hand side of FIG. 1 the straps 6 may be bent upwardly or downwardly to accommodate differences in the terrain and would still support and secure framing numbers 4. Framing member 4 and post 2 are covered by fence boards 8 which complete the fence blocking the view and preventing any intruders.

As seen at the left-hand side of FIG. 1, a gate may be accommodated by placing a 2×4 adjacent to post 2 to accept hinge fastening. At seen at the bottom of FIG. 1, the posts extend downwardly into the ground 9 to serve as an appropriate anchor for the fence.

The fence posts of the present invention are fabricated of a premolded concrete and as explained hereinafter can include a textured face as well as including longitudinal reinforcing means to secure the straps 6 in the appropriate positions.

Reference is now had to FIG. 2 wherein it can be seen that the framing means 4 are interconnected with straps 6 to secure them in position to post 2 which as seen in the cross-sectional view includes longitudinally or vertically extending reinforcing units 10.

As perhaps best seen in FIG. 3, the straps 6 are of a flat metallic material and extend entirely through the post 2 which is explained hereinabove is preferably made of a pre-formed cement material. Each of the straps 6 includes for convenience nailing holes 12 and the reinforcing elements 10 abut the sides of the straps 6 and are preferably welded thereto so that the elements are held in position during fabrication.

Attention is now directed to FIG. 4 which depicts a construction accommodating a 90° angle.

FIG. 5 illustrates how the inventive device can be used for an acute angle.

Thus, as can be seen, the present invention provides an inventive fence post which should last indefinitely and is used in conjunction with other materials which allows the provision of a fencing unit.

I claim:

1. A permanent fence post comprising:

an elongated main body portion fabricated of a permanent material, said main body portion including at least two parallel flat sides and a plurality of elongated reinforcing means extending substantially the entire length thereof, and a pair of spaced parallel rigid straps which extend between and are captured by the reinforcing means and which extend through the posts and extend outwardly thereof on the parallel sides to support an appropriate framework.

2. A modular fence comprising:

fence posts, framing means and fence boards, the fence posts fabricated of molded concrete including integral longitudinal reinforcing means capturing at least one pair of parallel straps substantially perpendicular to the axis of the reinforcing means and extending outwardly of at least one surface of the post, said straps being a predetermined distance apart to receive the end of the framing means, framing means of a predetermined length to extend between a pair of parallel posts, and fence boards for securement to the framing means substantially filling the space between the posts whereby a fence section is quickly and easily fabricated.

3. A modular fence as in claim 2, wherein the straps are adapted to receive framing at angles up to 90° in a horizontal plane and at acute angles in the vertical plane.

* * * * *